United States Patent [19]

Palmer

[11] 4,368,590

[45] Jan. 18, 1983

[54] FIRING PIN RETRACTOR MECHANISM FOR ELECTRICALLY-FIRED GUNS

[75] Inventor: John R. Palmer, Utica, N.Y.

[73] Assignee: Remington Arms Company, Inc., Bridgeport, Conn.

[21] Appl. No.: 163,309

[22] Filed: Jun. 26, 1980

[51] Int. Cl.[3] ..... F41C 19/12

[52] U.S. Cl. ..... 42/84; 42/23

[58] Field of Search ..... 42/23, 84; 89/24, 27 R, 89/27 A, 149

[56] References Cited

U.S. PATENT DOCUMENTS

| | | | |
|---|---|---|---|
| 383,372 | 5/1888 | Rostel | 89/24 |
| 449,711 | 4/1891 | VonSkoda | 89/24 |
| 458,505 | 8/1891 | VonSkoda | 89/24 |
| 617,110 | 1/1899 | Lynch | 89/24 |
| 1,040,001 | 10/1912 | Olsson | 89/24 |
| 2,415,952 | 2/1947 | Loomis | 89/24 |
| 2,800,057 | 7/1957 | Hoopes | 89/28 R |
| 2,977,855 | 4/1961 | Catlin et al. | 89/24 |
| 3,763,742 | 10/1973 | Kotas et al. | 89/24 |

*Primary Examiner*—Charles T. Jordan

*Attorney, Agent, or Firm*—Nicholas Skovran; William L. Ericson; Barry Estrin

[57] ABSTRACT

An electrically-fired gun, of the type having a breechblock slidable in a transverse passage across its breech, has a retractor mechanism mounted within the breechblock for retracting the firing pin electrode tip behind the face of the breechblock as it opens and closes. A retractor lever connected to the firing pin is controlled by positioning means comprising spring means biasing the lever in one direction, and a plunger cam cooperable with a wall of the transverse passage to displace the lever in an opposite direction. The positioning means serve to retract the firing pin when the breechblock is opened for reloading, and to extend it on reclosing.

8 Claims, 10 Drawing Figures

1
42
2
2
260
51
38
54
36
58
56
62
60
53
68
57
21
9
52
50
23
20
22
24
40
26
17
16
66
64
71
70
72
74
48
73
46
44

FIRING PIN RETRACTOR MECHANISM FOR ELECTRICALLY-FIRED GUNS

This invention relates to electrically-fired guns, especially those of the type having a breechblock which is slidable transversely to the barrel between an open position in which the chamber is accessible for loading of a shell, and a closed position in which the breechblock encloses the base of the shell for firing. The invention is particularly concerned with a mechanism for retracting a firing pin electrode behind the face of the breechblock during its opening and closing movements, so that the tip of the electrode will not be damaged by dragging it across the base of the shell and the breech of the barrel.

A number of known mechanisms for retracting firing pins in transverse-sliding breechblock guns employ mechanical linkages connected with the breechblock-operating mechanism. This is done in percussion-fired guns as an incident to cocking the firing pin, or in electrically-fired guns for the purpose of protecting the electrode tip. Some examples of such mechanisms are shown in U.S. Pat. Nos. 2,800,057—Hoopes; 617,110—Lynch; 1,040,001—Olsson; 383,372—Rostel; 449,711 and 458,505—von Skoda.

The present invention has as its general object the provision of an improved mechanism for retracting an electrical firing pin within a transversely-sliding breechblock as the breechblock is opened and closed. It is a feature of this retractor mechanism that the moving parts are entirely contained within the breechblock, so that its presence does not complicate the routine operation of removing the breechblock for cleaning or repair, and it is not subject to maladjustment when the breechblock is reassembled in the gun.

The improved firing pin retractor mechanism includes a retractor lever which is pivotally mounted in the breechblock, and drivingly connected with a firing pin assembly so that the lever is movable to displace the assembly to a retracted position against the bias of a firing pin spring, which normally urges the assembly into a firing position. A retractor plunger is pivotally connected to the retractor lever and has a cam surface which is extensible forwardly of the breechblock, for camming action against an edge portion of the gun's yoke or receiver that is formed by a transversely-extending breechblock passage.

In one embodiment of the invention, a retractor spring biases the retractor lever in a direction to retract the firing pin assembly. When the breechblock is substantially in its closed position, the retractor plunger's cam surface slides over the yoke edge to displace the retractor lever against the bias of the retractor spring, to a position which permits the firing pin spring to extend the firing pin assembly to its firing position. When the breechblock is displaced from its closed position, the plunger cam surface disengages the yoke edge, allowing the retractor spring to actuate the retractor lever to retract the firing pin assembly.

In another embodiment which has no retractor spring, the retractor plunger's cam surface slides over the yoke edge to a position which permits the firing pin spring to extend the firing pin assembly into firing position, only when the breechblock is substantially in its closed position. When the breechblock is displaced from the closed position, the plunger cam surface cooperates with the wall of the breechblock passage to displace the retractor lever in a direction to retract the firing pin assembly.

Figure 1:
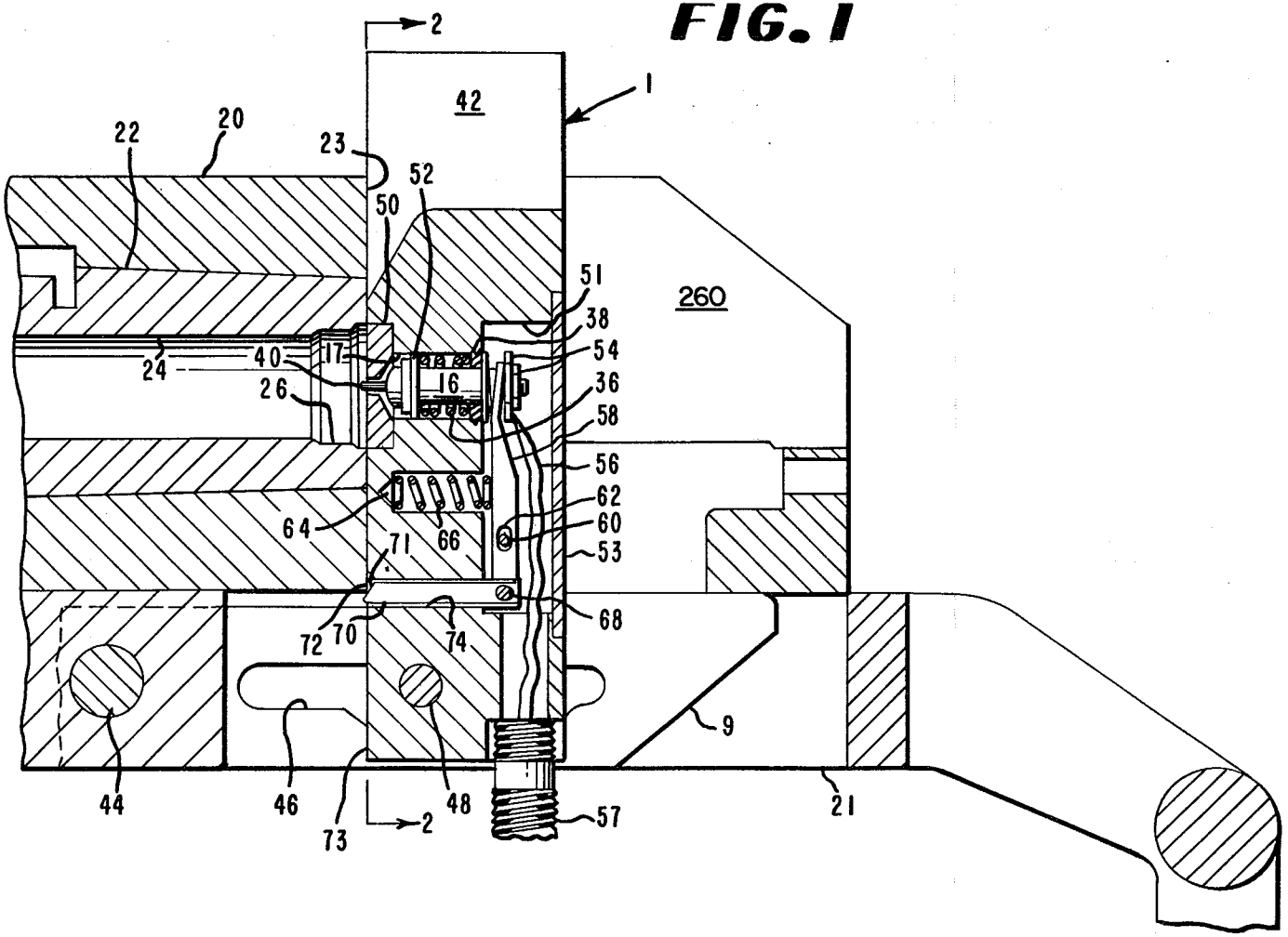
FIG. 1 is a fragmentary cross-sectional view in side elevation of a gun which incorporates a first embodiment of the improved retractor mechanism, showing a firing pin assembly in a firing position.
Figure 2:
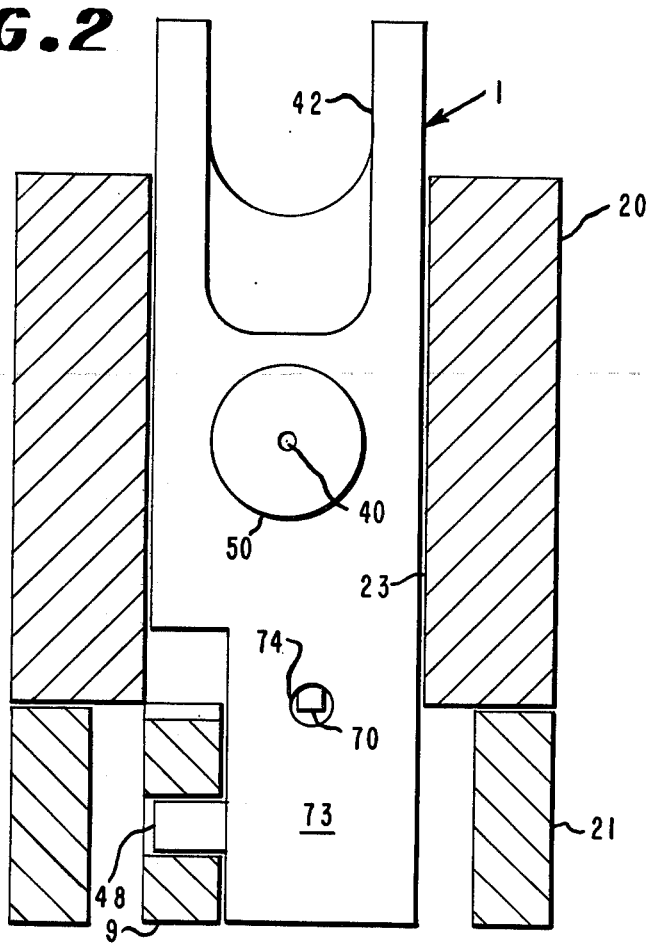
FIG. 2 is a fragmentary sectional view taken along line 2—2 in FIG. 1, looking in the direction of the arrows.

In the drawings, a first embodiment of the improved firing pin retractor is illustrated in FIGS. 1–5 in an electrically-fired conversion of an industrial gun of a type which is generally shown in U.S. Pat. Nos. 2,415,952—Loomis; 2,977,855—Catlin et al; and 3,763,742—Kotas et al. Guns of this kind have been used in percussion-fired versions for many years, primarily for the purpose of firing slugs into cement kilns to break up clinker rings. A recent development has also applied them to the field of geophysical exploration, as a means of impacting the earth to generate seismic waves from which subterranean geology can be determined. For this purpose, it is sometimes desired to fire a gun from a remote point, or to fire a number of guns simultaneously from a remote point; and this is conveniently provided for by using an electrical firing system.

The gun shown has a frame 21 on which are secured a yoke or receiver 20, and a barrel 22 mounted in the yoke. The bore 24 of the barrel is formed at its breech end with a chamber 26 for receiving an ammunition shell (not shown) having an electrically-ignited primer, and suitable for the intended use of the gun. The yoke 20 is formed with a rectilinear passage 23 extending transverse to the length of the barrel 22, and opening into the chamber 26. A breechblock 1 is slidable in the passage 23. An operating arm 9 is pivoted at 44 in the frame 21, and a pin 48 secured to the breechblock is slidably received in an elongated slot 46 in the operating arm. By turning the operating arm clockwise, as shown by the arrow in FIG. 4, the breechblock 1 may be lowered from the breech-closing position shown in FIG. 1, to an open position in which the chamber 26 is accessible for reloading. A reverse movement of the operating arm raises the breechblock to close the breech for firing. U-shaped recesses 42 and 260 are formed in the top of the breechblock and the yoke, respectively, to facilitate reloading. A cover plate 53 is removably secured to the rear face of the breechblock to prevent moisture and foreign matter from reaching an interior recess 51.

The breechblock 1 is formed with a stepped bore 17 that extends through a pressure plate 50 secured in the front face of the breechblock. The bore 17 is concentric with the axis of the bore 24 of the barrel 22 in the closed position of the breechblock shown in FIG. 1. An electrical firing pin assembly 16 is slidably received in the bore 17 for movement between a retracted position shown in FIG. 4, in which an electrode tip 40 is withdrawn behind the front surface 73 of the breechblock, and a firing position shown in FIGS. 1 and 3, in which the electrode tip protrudes from the breechblock for contact with the primer of a shell (not shown) seated in the chamber 26.

Figure 3:
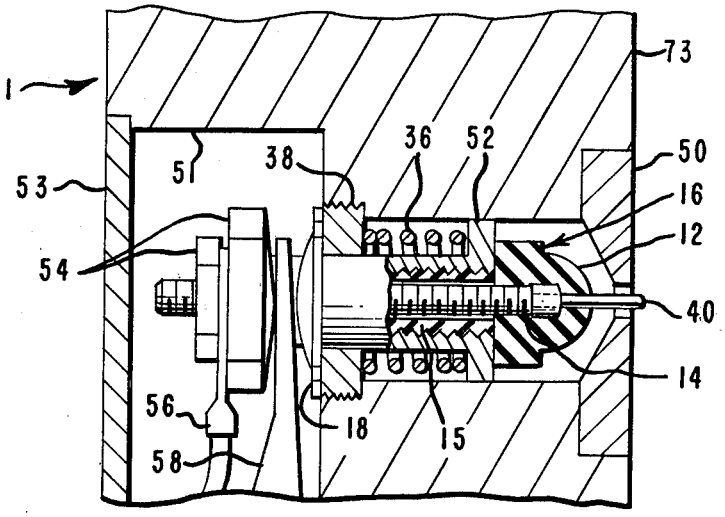
FIG. 3 is a fragmentary sectional view in side elevation, and on an enlarged scale, of the firing pin assembly of FIG. 1.

The firing pin assembly 16, which is best shown in FIG. 3, includes a flanged tubular housing 52 slidable in the bore 17. A firing pin spring 36 is compressed between the flanged housing and a retaining plug 38 threaded in the breechblock, and biases the firing pin assembly toward its firing position. An insulating bushing 15, formed of a suitable insulating material, is threaded in the housing 52, and receives a firing pin stud 14. The electrode tip 40, which is made of a suitable spark erosion-resistant material, is brazed into a hole in the stud 14. The stud is secured to the housing 52 by nuts 54 and an insulated cap 12 threaded on its opposite ends.

An insulated electrical lead 56 is clamped in electrical contact with the stud 14 by the nuts 54. The lead 56 is also connected to a conventional receptacle 57 (see FIG. 1) for electrical connection to a suitable switch and power source (not shown). A circuit is completed from the power source through the tip 40, the primer of a shell seated in the chamber 26, the gun barrel, and thence to ground, when the firing pin assembly is advanced as in FIGS. 1 and 3, and the switch is closed to fire the shell.

The firing pin assembly 16 is movable to its retracted position against the bias of the spring 36 by a retractor lever 58, which is pivotally mounted in the breechblock on a pin 60 received through an elongaged slot 62 in the rocker arm. The upper end of the retractor lever is interposed between the nuts 54 and a nut 18 secured on the housing 52, to drivingly connect the firing pin assembly with the retractor lever for retraction thereby. A retracting spring 66 is received in a blind hole 64 in the breechblock, and biases the retractor lever 58 in a clockwise direction as viewed in FIG. 1. The spring 66 has a greater spring constant than the firing pin spring 36, and will act to retract the firing pin assembly to the position of FIG. 4 unless it is restrained from doing so.

The lower end of the retractor lever 58 is pivotally connected by a pin 68 with a retractor plunger 70, which extends slidably through a hole 74 to the front surface 73 of the breechblock 1, and terminates in a sloping cam surface 71. In the closed position of the breechblock shown in FIG. 1, the cam surface 71 is displaced rearwardly by engagement with an edge portion 72 of the yoke 20 formed by the intersection with its lower surface of the transverse passage 23. This tilts the retractor lever 58 counterclockwise against the compression of the spring 66, and permits the spring 36 to extend the firing pin assembly 16 to its illustrated firing position.

Figure 4:
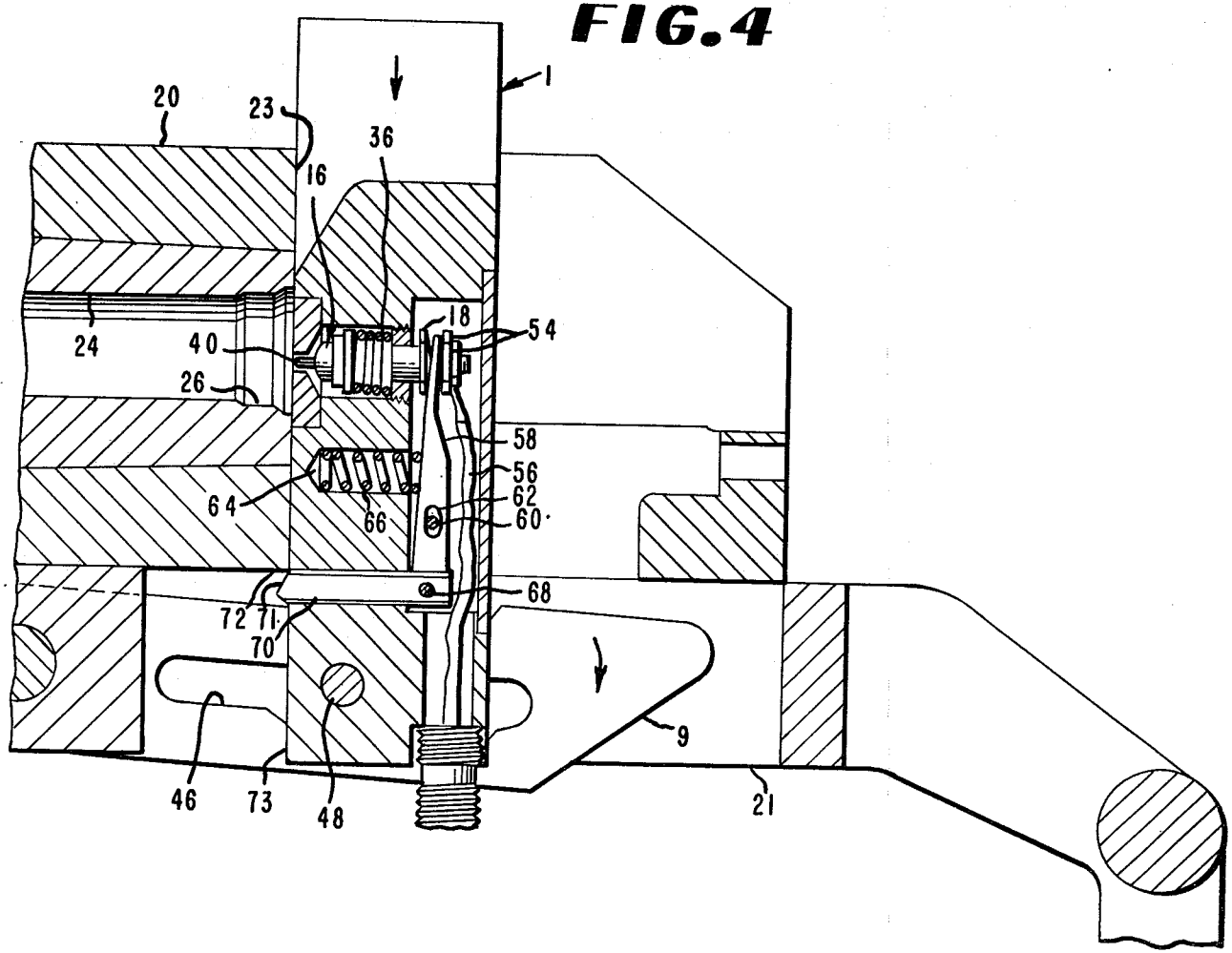
FIG. 4 is a view similar to FIG. 1, but showing the firing pin assembly in a retracted position.
Figure 5:
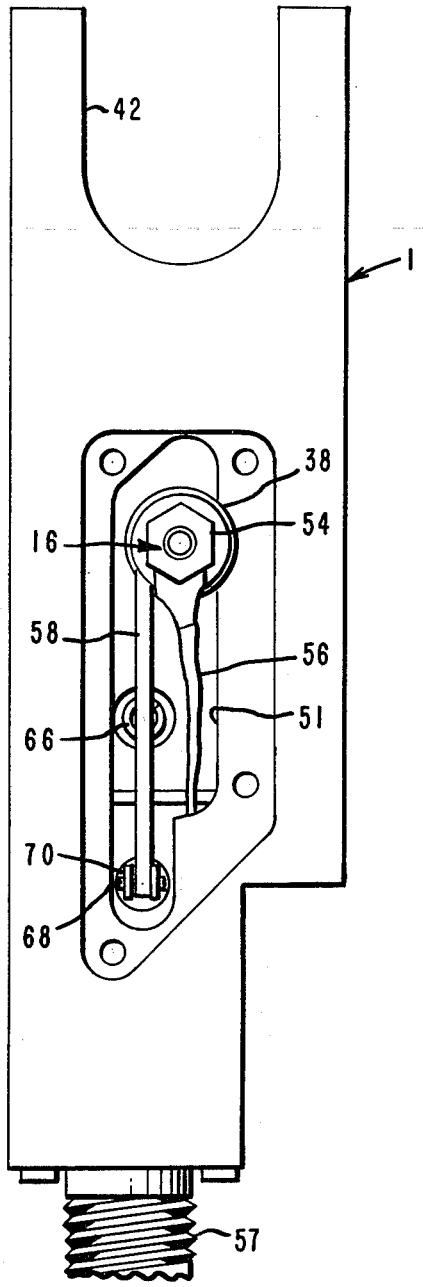
FIG. 5 is a view in rear elevation of the breechblock of the gun shown in FIG. 1, with a cover plate removed.

In FIG. 4, the operating arm 9 is shown commencing to turn clockwise to lower the breechblock 1, and open the chamber 26 for reloading. At a very early stage of this motion, the cam surface 71 disengages from the edge 72, and allows the spring 66 to tilt the retractor lever 58 clockwise around the pin 60, thereby withdrawing the firing pin assembly 16 rearwardly into its retracted position by compressing the spring 36. The rate of firing pin retraction is determined by the slope of the cam surface 71. The electrode tip 40 is thus withdrawn behind the front surface 73 of the breechblock and protected from possible damage by wiping across the base of a shell in the chamber 26 and striking the edge of the chamber as the breechblock is opened. It will be apparent that the firing pin will remain retracted until the breechblock is once again approaching the final phase of closing movement.

Referring now to FIGS. 6–10, another embodiment of the invention is shown in a breechblock 81, assembled in a gun that is otherwise identical with the gun of FIGS. 1–5, and whose parts are numbered alike. The breechblock 81 has a U-shaped recess 83 in its upper surface, an interior recess 96 receiving the firing mechanism, and a removable cover plate 94 for excluding moisture and foreign matter. It is formed with a stepped bore 85 that extends through a pressure plate 50 secured in the front face of the breechblock. The bore 85 is concentric with the barrel bore 24 in the closed position of the breechblock shown in FIG. 6.

Figure 6:
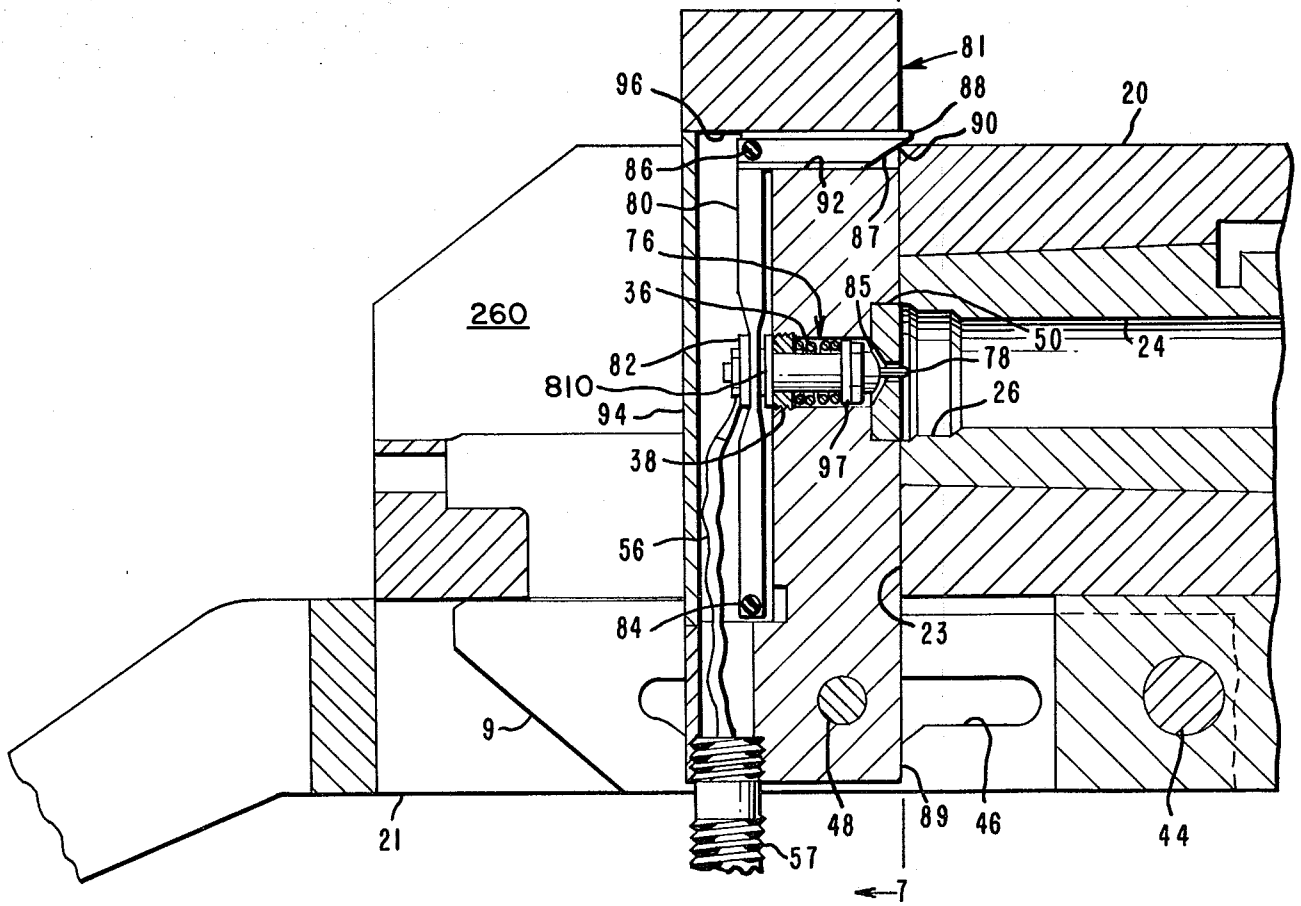
FIG. 6 is a fragmentary cross-sectional view in side elevation of a gun which incorporates a second embodiment of the improved retractor mechanism, showing a firing pin assembly in firing position.
Figure 7:
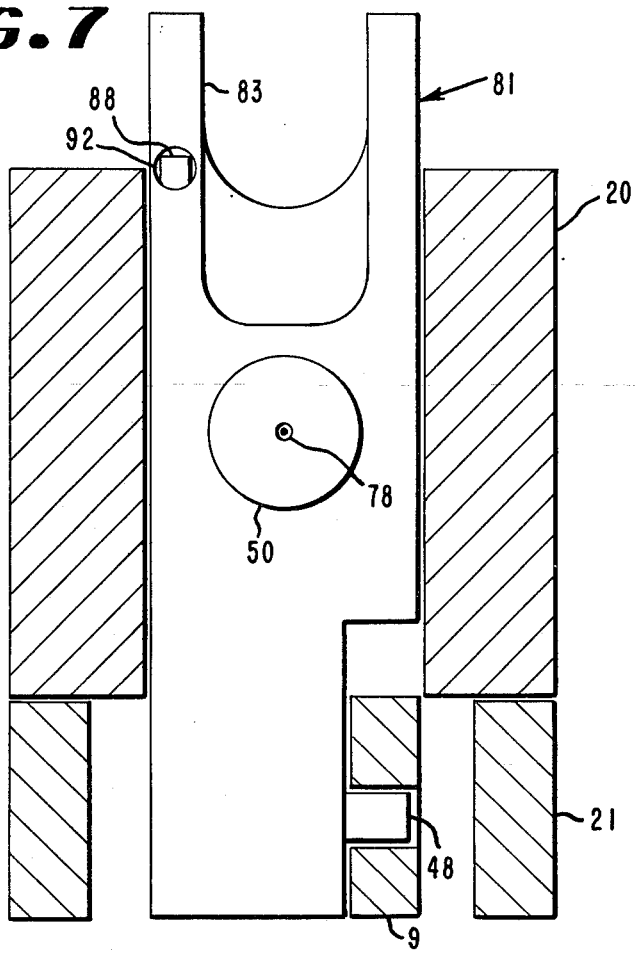
FIG. 7 is a fragmentary sectional view taken along line 7—7 in FIG. 6, looking in the direction of the arrows.
Figure 8:
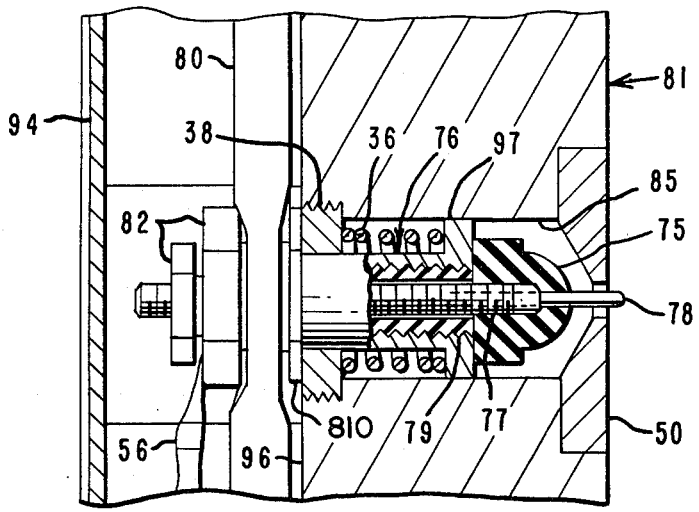
FIG. 8 is a fragmentary sectional view in side elevation, and on an enlarged scale, of the firing pin assembly of FIG. 6.
Figure 9:
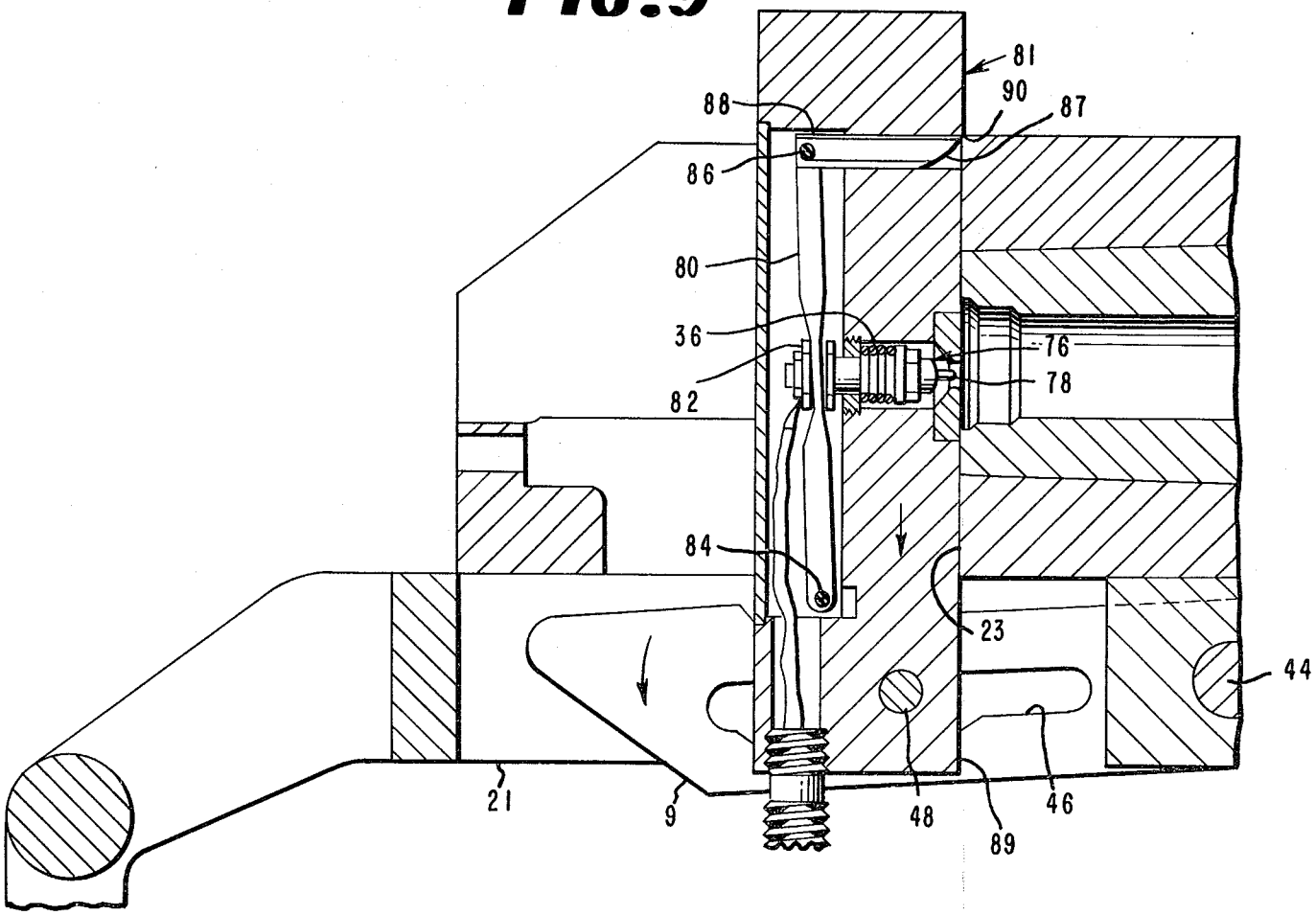
FIG. 9 is a view similar to FIG. 6, but showing the firing pin assembly in a retracted position.
Figure 10:
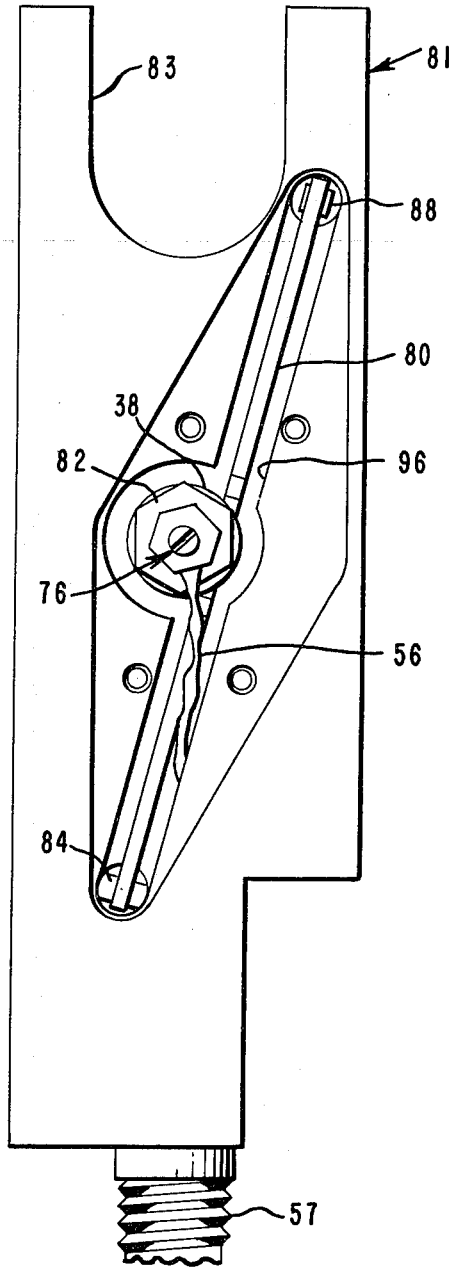
FIG. 10 is a view in rear elevation of the breechblock of the gun shown in FIG. 6, with a cover plate removed.

An electrical firing pin assembly 76 is slidably received in the bore 85 for movement between a retracted position shown in FIG. 9, in which an electrode tip 78 is withdrawn behind the front surface 89 of the breechblock, and a firing position shown in FIGS. 6 and 8, in which the electrode tip protrudes from the breechblock for contact with the primer of a shell (not shown) seated in the chamber 26.

The firing pin assembly 76 is best shown in FIG. 8, and includes a flanged tubular housing 97 slidable in the bore 85. The firing pin spring 36 is compressed between the flanged housing and a retaining plug 38 threaded in the breechblock, and biases the firing pin assembly forwardly toward its firing position. An insulating bushing 79, formed of a suitable insulating material, is threaded in the housing 97, and receives a firing pin stud 77. The electrode tip 78, which is made of a suitable spark erosion-resistant material, is brazed into a hole in the stud 77. The stud is secured to the housing by nuts 82 and an insulated cap 75 threaded on its opposite ends. An insulated electrical lead 56 is clamped in electrical contact with the stud 77 by the nuts 82, and is also connected to a receptacle 57 (see FIG. 1) for electrical connection to a suitable switch and power source for selectively energizing the electrode tip 78 to fire the gun.

The firing pin assembly 76 is movable to its retracted position against the bias of the spring 36 by a retractor lever 80, which is pivotally mounted in the breechblock by a pin 84. The flanged housing 97 passes through the retractor lever, to which it is drivingly connected by the nuts 82 and a nut 810 secured on the flanged housing. The upper end of the retractor lever is pivotally connected by a pin 86 with a retractor plunger 88, which extends slidably through a hole 92 to the front surface 89 of the breechblock 1, and terminates in a sloping cam surface 87. In the closed position of the breechblock shown in FIG. 6, the cam surface 87 extends partially above and forward of an edge portion 90 of the yoke 20 formed by the intersection of its upper surface with the transverse passage 23. This permits the spring 36 to draw the retractor lever 80 sufficiently far forward to extend the firing pin assembly into the firing position of FIG. 6.

In FIG. 9, the operating arm 9 is shown commencing to turn counterclockwise to lower the breechblock 81 for reloading. As the breechblock begins to move downward, the cam surface 87 is displaced rearwardly until it engages the forward wall of the transverse passage 23, against which it slides throughout the remainder of the breech-opening movement. The retractor lever 80 is thus displaced in a counterclockwise direction, and retracts the firing pin assembly 76 by compressing the spring 36. The tip 78 remains retracted behind the front surface 89 of the breechblock throughout its cycle of motion, until the cam surface 87 once again moves above the yoke edge 90 just before the end of the closing movement.

I claim:

1. In an electrically-fired gun which includes a barrel having an open breech; a yoke secured to said barrel and formed with a passage communicating with said breech and having a wall extending transversely to the length of said barrel; a breechblock having a surface conformable to said passage wall and slidably received in said passage; means for reciprocating said breechblock in said passage between positions opening and closing said breech; electrical firing pin means reciprocable in said breechblock between a firing position protruding from said breechblock into said breech for electrical firing contact with a shell received in said barrel, and a position retracted within said breechblock;

an improved firing pin retractor mechanism comprising, in combination: a retractor lever connected with said firing pin means and mounted in said breechblock for movement to a position retracting said firing pin means, and to a position releasing said firing pin means for displacement to said firing position; and lever-positioning means including a firing pin spring biasing said firing pin means toward said firing position, and said retractor lever toward said releasing position; said lever-positioning means further including a plunger movably mounted in said breechblock, drivingly connected with said retractor lever, and formed with a cam surface extensible from said breechblock surface for sliding engagement with said passage wall; said lever-positioning means being constructed and arranged to move said retractor lever to said retracting position in response to displacement of said breechblock from said breech-closing position, and to said releasing position in response to displacement of said breechblock into said breech-closing position.

2. A firing pin retractor mechanism as recited in claim 1, said passage wall intersecting an exterior surface of said yoke to define a yoke edge portion; said cam surface slidably engaging said yoke edge portion in said breech-closing position of said breechblock, and thereby being located for movement of said retractor lever to said releasing position by said lever-positioning means.

3. A firing pin retractor mechanism as recited in claim 1, said lever-positioning means including a retractor spring biasing said retractor lever toward said retracting position; said cam surface cooperating with said passage wall, in said breech-closing position of said breechblock, to move said retractor lever to said releasing position against the bias of said retractor spring.

4. A firing pin retractor mechanism as recited in claim 3, said breechblock being constructed and arranged to disengage said cam surface from cooperation with said passage wall upon displacement of said breechblock from said breech-closing position.

5. A firing pin retractor mechanism as recited in claim 1, said passing wall intersecting an exterior surface of said yoke to define a yoke edge portion; said cam surface cooperating with said passage wall, upon displacement of said breechblock from said breech-closing position, to move said retractor lever to said retracting position; said cam surface slidably engaging said yoke edge portion upon movement of said breechblock into said breech-closing position, and thereby being located for movement of said retractor lever to said releasing position by said lever-positioning means.

6. In an electrically-fired gun which includes a barrel having an open breech; a yoke secured to said barrel and formed with a passage communicating with said breech and having a wall extending transversely to the length of said barrel; a breechblock having a surface conformable to said passage wall and slidably received in said passage; means for reciprocating said breechblock in said passage between positions opening and closing said breech; electrical firing pin means reciprocable in said breechblock between a firing position protruding from said breechblock into said breech for electrical firing contact with a shell received in said barrel, and a position retracted within said breechblock;

an improved firing pin retractor mechanism comprising, in combination: a firing pin spring biasing said firing pin means toward said firing position; a retractor lever connected with said firing pin means and mounted in said breechblock for movement to a position retracting said firing pin means, and to a position releasing said firing pin means for displacement by said firing pin spring to said firing position; a retractor spring operative, upon movement of said breechblock from said breech-closing position, to move said retractor lever to said retracting position against the bias of said firing pin spring; and a plunger movably mounted in said breechblock, drivingly connected with said retractor lever, and having a cam surface engaging said passage wall in said breech-closing position of said breechblock to move said retractor lever to said releasing position against the bias of said retractor spring.

7. A firing pin retractor mechanism as recited in claim 6, said passage wall intersecting an exterior surface of said yoke to define a yoke edge portion terminating said passage wall; said plunger cam surface slidably engaging said yoke edge portion in said breech-closing position of said breechblock, and being disengaged from said yoke edge portion by displacement of said breechblock from said breech-closing position.

8. In an electrically-fired gun which includes a barrel having an open breech; a yoke secured to said barrel and formed with a passage communicating with said breech and having a wall extending transversely to the length of said barrel; a breechblock having a surface conformable to said passage wall and slidably received in said passage; means for reciprocating said breechblock in said passage between positions opening and closing said breech; electrical firing pin means reciprocable in said breechblock between a firing position protruding from said breechblock into said breech for electrical firing contact with a shell received in said barrel, and a position retracted within said breechblock;

an improved firing pin retractor mechanism comprising, in combination: a retractor lever connected with said firing pin means and mounted in said breechblock for movement to a position retracting said firing pin means, and to a position releasing said firing pin means for displacement to said firing position; a firing pin spring biasing said firing pin means toward said firing position, and biasing said retractor lever toward said releasing position; and a plunger movably mounted in said breechblock, drivingly connected with said retractor lever, and having a cam surface engaging said passage wall, in positions of said breechblock displaced from said breech-closing position, to move said retractor lever to said retracting position against the bias of said firing pin spring; said passage wall intersecting an exterior surface of said yoke to define a yoke edge portion terminating said passage wall; said plunger cam surface slidably engaging said yoke edge portion in said breech-closing position of said breechblock, and thereby freeing said retractor lever and said firing pin means for movement by said firing pin spring.

* * * * *